United States Patent [19]

Brulfert

[11] 4,089,303

[45] May 16, 1978

[54] BOILER OR VAPOR GENERATOR USING CATALYTIC COMBUSTION OF HYDROCARBONS

[76] Inventor: André Brulfert, 6 rue des Pentres Parrocel, Avignon, France

[21] Appl. No.: 692,111

[22] Filed: Jun. 2, 1976

[30] Foreign Application Priority Data

Jun. 3, 1975 France ..... 75 17850

[51] Int. Cl.[2] ..... F22B 27/08; F23D 13/18

[52] U.S. Cl. ..... 122/250 R; 122/4 D; 431/328

[58] Field of Search ..... 122/250 R, 249, 248, 122/367 R, 367 C, 367 PF, 4 D; 431/328

[56] References Cited

U.S. PATENT DOCUMENTS

| | | | |
|---|---|---|---|
| 3,282,257 | 11/1966 | McInerney et al. | 122/250 |
| 3,563,211 | 2/1971 | Hornbostel, Jr. | 122/250 |
| 3,563,212 | 2/1971 | Hoagland | 122/367 |
| 3,877,441 | 4/1975 | Mach et al. | 122/367 |

FOREIGN PATENT DOCUMENTS

| | | | |
|---|---|---|---|
| 2,349,294 | 4/1974 | Germany | 122/4 |

*Primary Examiner*—Kenneth W. Sprague
*Attorney, Agent, or Firm*—Karl F. Ross

[57] ABSTRACT

A boiler or vapor generator using catalytic combustion of hydrocarbons to evaporate a fluid passed through pipes operates in accordance with the principles of U.S. Pat. Nos. 3,908,602 and 3,952,707 and comprises vertically disposed catalyst elements within a thermally insulated housing. The space between the catalyst elements, which face one another, is occupied by a pair of coiled tubes which are superposed so as to be imbricated in one another. The tube coils shield the catalyst elements from radiation interchange of heat. The two coiled tubes are connected with a lower supply tube and an upper collector and are traversed by the liquid to be vaporized and heated so as to form a wall without interstices between the catalyst panels.

12 Claims, 5 Drawing Figures

BOILER OR VAPOR GENERATOR USING CATALYTIC COMBUSTION OF HYDROCARBONS

FIELD OF THE INVENTION

The present invention relates to a boiler or vapor generator using catalytic combustion of hydrocarbons to provide the heat necessary to vaporize a fluid. More particularly, the invention relates to vapor generators having a pair of vertical catalytic heaters between which tubes are provided for the fluid to be vaporized.

BACKGROUND OF THE INVENTION

Vapor generators or boilers for water in which catalyst elements are disposed vertically in the interior of the thermally insulated housing and have the space between the catalyst elements occupied by tubes conducting the liquid to be vaporized from the bottom to the top are known, for example, from U.S. Pat. No. 3,908,602 issued Sept. 30, 1975 to me jointly with Andre Gabriel Hoss. The tube arrays in this patented system are constituted by planar bundles of vertical tubes which are fed from below by common supply tubes or manifolds and are provided, at their tops, with common collectors.

To block the direct radiation from one catalyst heating panel upon another, through the interstices between the tubes of a planar array, it was found to be necessary to provide shields in the form of an array of vanes so as to form a wall free from interstices between the catalyst panels. The walls between pairs of juxtaposed or confronting, spaced-apart catalyst panels, prevent direct radiation from one catalyst panel on the other.

U.S. Pat. No. 3,952,707, issued to me on Apr. 27, 1976, discloses another arrangement, different from the first, for carrying out catalyst combustion of a hydrocarbon and heating of a fluid thereby without direct radiation of heat from one catalyst panel onto the other. In this arrangement the space between the two catalyst elements is occupied by a vertical casing of small thickness which communicates with a lower fluid-supply tube and with an upper collector duct. The casing thus forms a hollow partition or shield, completely free from interstices and continuous between the catalyst element.

For maximum utilization of the thermal output of the device other casings of this type can be disposed outwardly of the catalyst elements and at the top of the generator so as to form outer walls and the roof thereof.

These systems have proved to be highly successful in preventing the direct radiation phenomenon described above and exploiting to a considerable extent the thermal energy of the catalyst agents.

OBJECTS OF THE INVENTION

It is an object of this invention to provide a further-improved boiler or vapor generator, utilizing the principles of the earlier systems described above, which is of simplified construction, lower cost and high thermal efficiency.

SUMMARY OF THE INVENTION

This object and others which will become apparent hereinafter are attained, in accordance with the present invention, in a boiler or vapor generator in which the space between the catalyst elements receives a wall free from interstices and formed by two tubes coiled in respective helices and disposed in imbricated relationship with respect to one another.

According to the invention, the successive turns of one helix receive between them the successive turn of the other helix so that each turn of one helix osculates a pair of turns of the other helix whereby the two helices form a wall free from interstices.

The two coils communicate on the one, hand with a lower supply tube and, on the other hand, with an upper vapor collector. The helices are traversed by the liquid to be vaporized and heated, the liquid passing in an upward direction.

Where the catalyst heaters are rectangular panels, it is advantageous to constitute the helices or coils with a generally rectangular plan or turn pattern as viewed in the direction of the axis of the coil.

The two coils receive the heat emitted by the catalyst elements, which are spacedly juxtaposed, while preventing direct radiation from one panel onto the other. They thereby constitute a shield disposed between the panels.

One of the advantages of the present system is that welding of the two coils together (or soldering) can be avoided and it is merely necessary to connect each coil via suitable fittings to the lower supply tube and the upper collectors.

According to a feature of the invention, to increase the heat exchange surface area and obtain maximum utilization of the thermal energy generated in the device, another coil of spiral configuration, formed by superposed turns of tubing, is provided along the back of each of the panels.

Still further improvement in the thermal energy utilization can be obtained, in accordance with still another feature of the invention, when the space above the panels and the helical coils is cupola or dome-shaped and is formed by further tubes coiled in a spiral and also traversed by the liquid to be vaporized or heated. These supplemental tubes constitute, in fact, a collecting wall for the gases resulting from the combustion and can guide these gases to a chimney or other outlet.

BRIEF DESCRIPTION OF THE DRAWING

The above and other objects, features and advantages of the invention will become more readily apparent in the following description, reference being made to the accompanying drawing in which.

SPECIFIC DESCRIPTION

Figure 1:
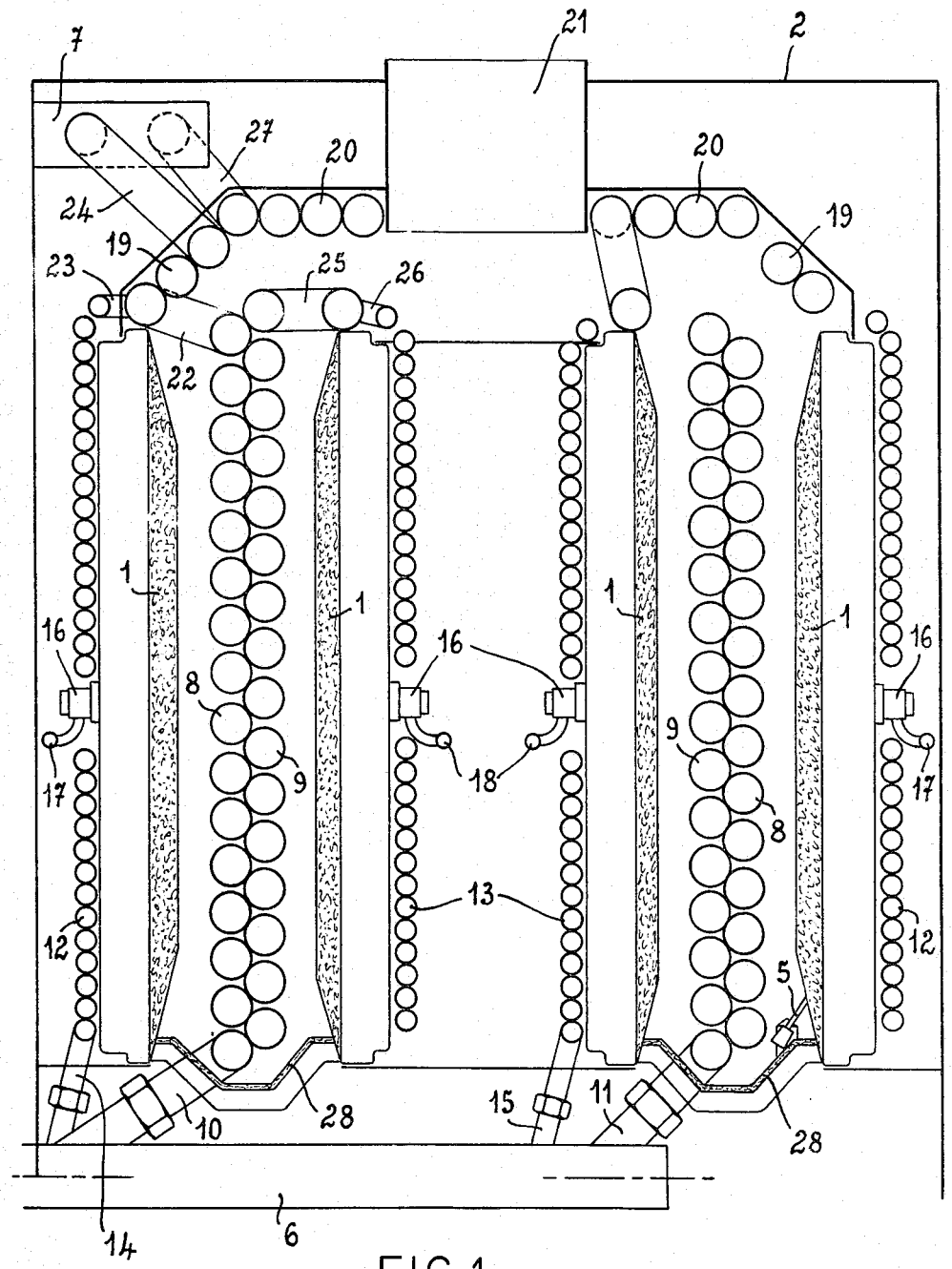
FIG. 1 is a diagrammatic vertical section through a vapor generator or boiler according to the invention.

As has been described previously in U.S. Pat. Nos. 3,908,602 and 3,952,707, a boiler or vapor generator can comprise catalyst elements 1 in the form of panels which are disposed vertically within a thermally insulated housing 2. The panels 1 are positioned in pairs and confront one another (FIG. 1). They can be of any fluid-permeable material capable of catalyzing the oxidation of hydrocarbons. The panels may have the structures described in the aforementioned patents and can be of platinum-sponge, cobalt, ferronickel or other catalyst material known to serve as a catalyst in the oxidation of hydrocarbons such as methane. The panels are supplied with the latter fuel by ducts 3 and 4 which extend into the base of the housing 2 and can be triggered by operation of an igniter represented diagrammatically at 5. The igniter system is well-known and need not be described in detail herein (see U.S. Pat. No. 3,902,707, for example).

The liquid to be vaporized or heated is also supplied to the housing 1 at its base by a feed tube 6 and the hot liquid or vapors are recovered by a collector 7 at the top of the housing 2 and formed, for example, as a steam distributor. Between the feed tube 6 and the collector 7, the liquid follows a rising path during which it absorbs the thermal energy used by the catalytic combustion.

Figure 2:
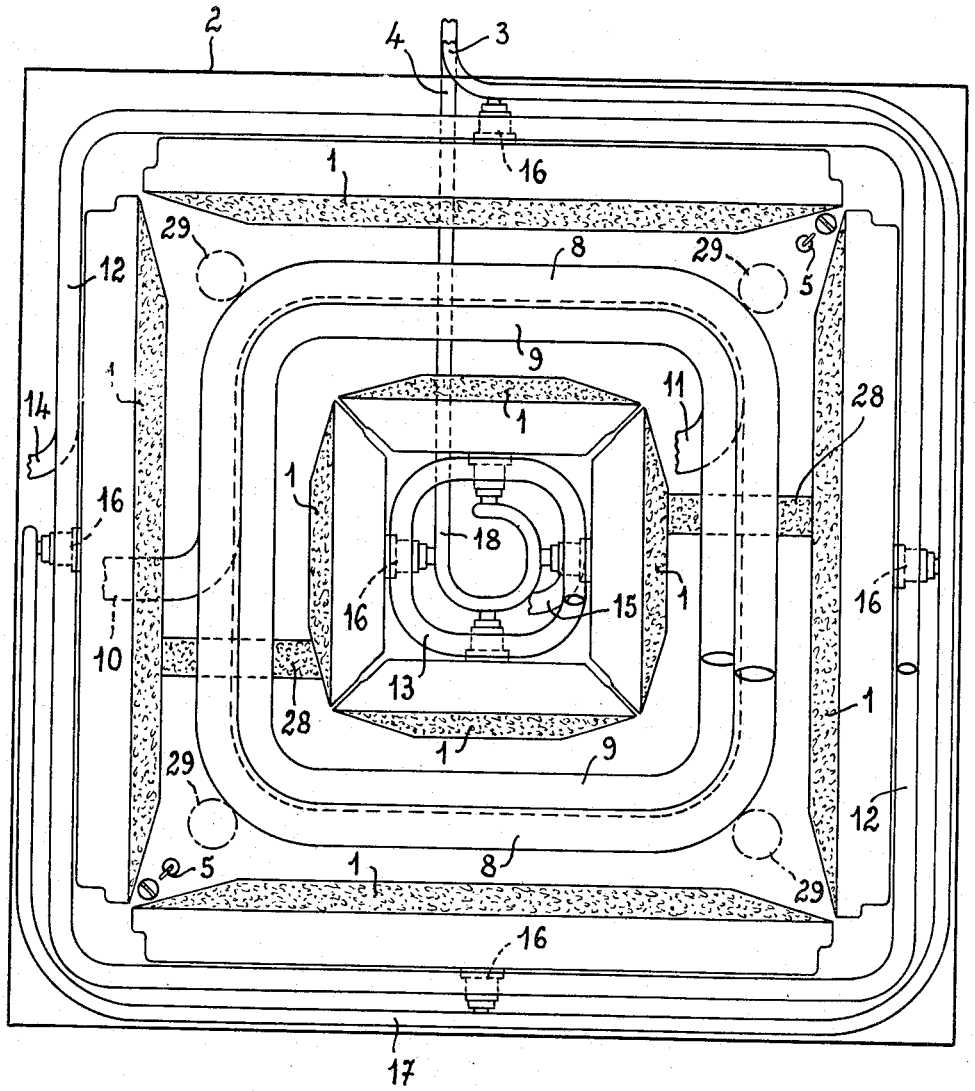
FIG. 2 is a diagrammatic horizontal section through this unit.

In the first embodiment of the invention, illustrated in FIGS. 1 and 2, the vapor generator has a square horizontal cross-section and four pairs of catalyst panels are provided, one member of each pair forming an outer rectangle and the other member of each pair forming an inner rectangle.

The space between the panels of each pair receives a pair of tubes 8 and 9 coiled in helices of rectangular section and having spaced-apart superposed turns with the turns of one helix lying within the spaces between the turns of the other helix in an imbricate fashion. The two helices 8 and 9 thus form a shield between the panels of each pair which is free from interstices and extends the full height of the panels 1, blocking direct radiation from one panel of each pair onto the other.

The coil 8 is supplied with water from the feed tube 6 by a first conduit 10 while the coil 9 is fed from the same feed tube 6 with water via a second conduit 11 (FIG. 1).

Other tubes 12 and 13 are coiled in helices along the backs of the outer panels and inner panels, respectively. These two supplemental coils 12 and 13 are connected to the feed tube 6 via further conduits 14 and 15 and likewise serve to heat the water by radiation or conduction from the panels.

At a certain level, e.g. about midway of the height of the unit, the coils 12 and 13 have spaced-apart turns to clear the fuel inlets 16 which are connected with the ducts 3 and 4 by pipes 17 and 18.

The top of the generator is formed with an inwardly converging tube coil 19, forming an extension of the coil 8 and connected thereto via duct 22 and discharging into the collector 7. A further spirally wound coil 20 is connected via duct 25 to the tube coil 9 and opens into the collector 7 via a duct 27. The tubes 19 and 20, which are spirally coiled, form a collecting cupola for the fumes which rise from the catalyst heating panels and direct the gases to a central chimney or stack 21.

Coils 19 and 20 are of a single layer in the embodiment of FIGS. 1 and 2 and the successive turns of their spirals can be soldered or welded together to seal the cupola against the escape of gas. A duct 23 can connect the outer coil 12 to the coil 19 as well. The inner coil 13 is connected via duct 26 to the coil 20.

Catalyst bridge members 28 may connect the panels of the opposing pairs and panels of the inner and outer sets to that only a single igniter 5 can be used to trigger the operation of all of the catalyst combustion panels.

Figure 3:
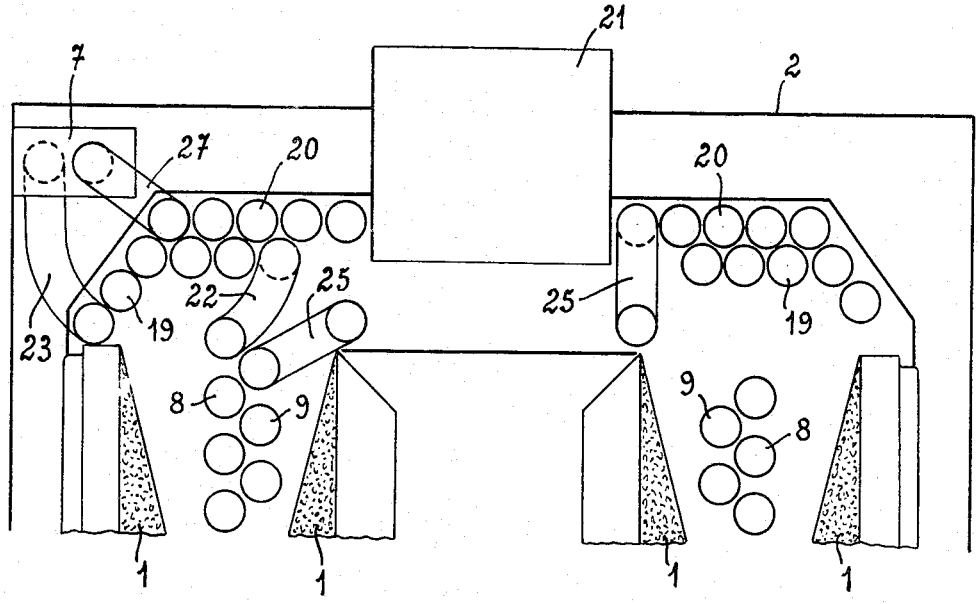
FIG. 3 is a partial vertical section, in diagrammatic form, of another embodiment of the invention.

In the embodiment illustrated in FIG. 3, the cupola is formed by a double layer of tubes whereby the tubes 19 and 20 are disposed in imbricated relationship, i.e. the turns of the two layers are staggered, in the same manner as the principal coils 8 and 9, to form a fluidtight wall. In this case, the tube coils 12 and 13 can be omitted and the coil 8 is connected vai duct 22 to the coil 19 while the coil 9 is connected via duct 25 to the coil 20. The coils 19 and 20 are connected respectively by the ducts 23 and 27 to the collector 7.

Additional tubes 29 can be provided at the vertices of the device, as shown in dot-dash lines, to suppoert the coils 8 and 9 and thereby ensure their rigidity. If such tubes 29 are provided, they are preferably located at the bends of coils 8.

The system described operates precisely in the manner set forth in the aforementioned patents in that the water is passed upwardly through the tubes 8, 9, 12, 13, etc. and is heated to generate steam.

The apparatus described can be modified within the spirit and scope of the invention without deviating from the essential principles.

For example, the shape of the generator can be modified so that the rectangular configuration illustrated can be replaced by a system which is polygonal, circular or of other form in horizontal section.

The rear coils 12 and 13 can be eliminated as has already been suggested or can be replaced by liquid-carrying cases as described in U.S. Pat. No. 3,952,707.

Instead of the coils being connected in parallel for use in common steam or vapor generating circuit, one or more of the coils can be used as part of an independent circuit, for example to supply hot water for washing purposes. In this case, one of the two upper cupola-forming coils is preferably used as a hot-water supply coil.

Figure 4:
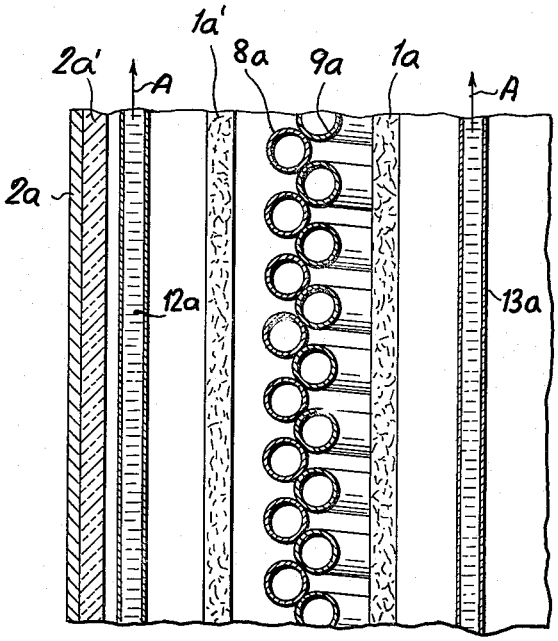
FIG. 4 is a fragmentary vertical section of a portion of another embodiment of the invention showing only a pair of the juxtaposed panels.

In FIG. 4 I have shown a modification of the earlier described system in which, in place of the tube coils 12 and 13 which are disposed rearwardly of the catalytic-combustion panels, relatively thin tanks are employed to form continuous vertical sheets of liquid running from the inlet to the collector. The principle is described in my U.S. Pat. No. 3,952,707, in which such tanks are shown at 22.

Thus, between the wall **2*a* of the housing and its thermally insulating lining 2*a*' and the back of an outer panel 1*a*', there is provided a slender tank 12*a*** which is traversed by the liquid to be heated in the direction of the arrow A.

Spaced from the face of the panel **1*a*', as described in connection with FIGS. 1–3, however, are the two coils 8*a* and 9*a*** which conduct the main flow of the liquid to be heated.

The inner panel **1*a*, which confronts the panel 1*a*' but cannot be radiated upon directly therefrom or directly irradiate the panel 1*a*' because of the wall fromed by the imbricated coils 8*a* and 9*a*, also has a tank 13*a* to conduct the liquid upwardly along the rear of this panel 1*a***.

Figure 5:
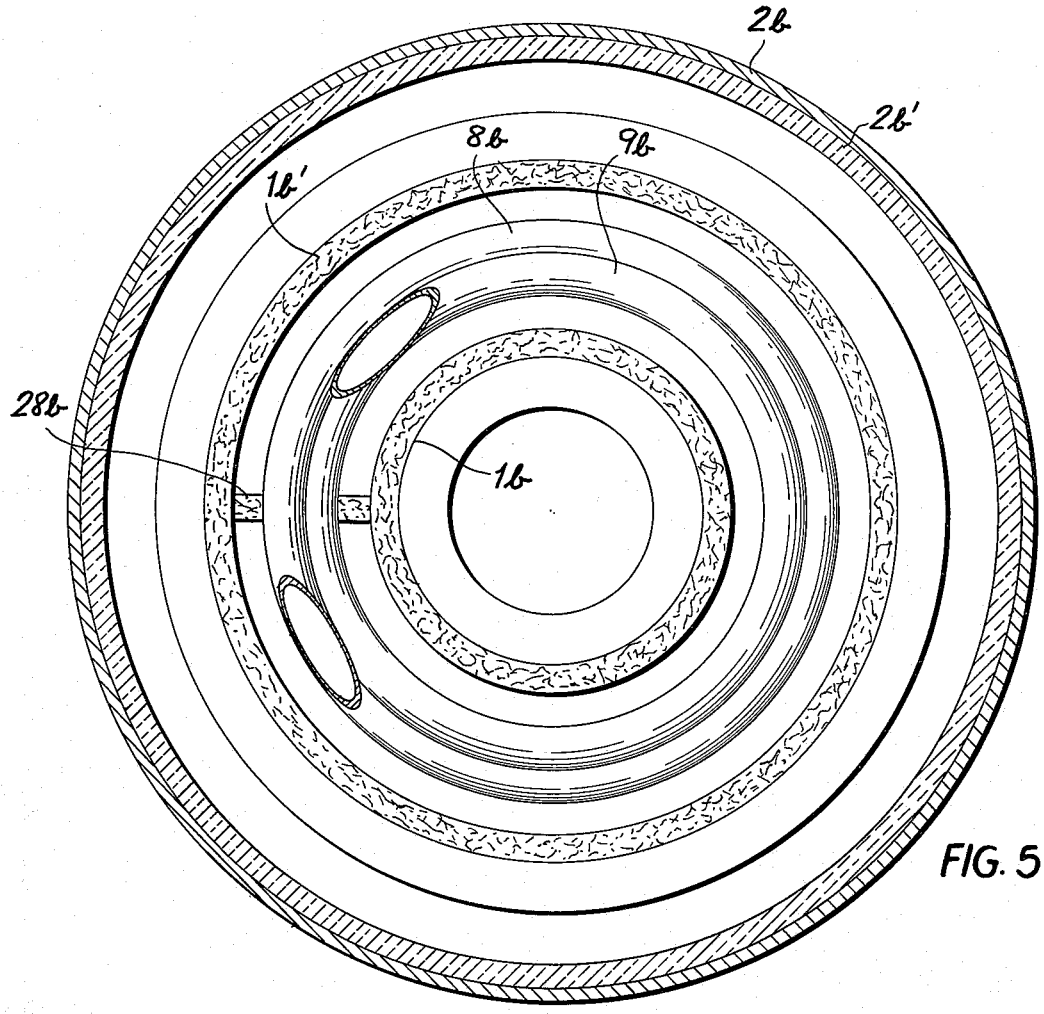
FIG. 5 is a horizontal cross-section diagrammatically illustrating another embodiment of the invention.

A further modification of the embodiment of FIGS. 1 – 3 is shown in FIG. 5 wherein instead of rectangular catalytic panels and a polygonal plane configuration of the housing or device, the inner catalyst element **1*b* is of cylindrical configuration with its catalyst layer facing outwardly. In this case, the tube coils 8*b* and 9*b* are formed as cylindrical helices whose generatrices are rotated at a fixed distance about the axis of the boiler or vapor generator. In this embodiment as well, the coils 8*b* and 9*b*** are imbricated and are connected at their bottoms with a common-liquid feedline and at their top with an appropriate collector.

Coaxial to the right-cylindrical helical coils 8b and 9b is the outer heating element 1b' whose catalyst layer faces inwardly.

The heating element 1b' is, in turn, surrounded by a housing 2b internally lined by an insulating layer 2b'.

Layers 2a' and 2b' can also be provided upon the housing structure 2 of FIGS. 1 - 3 and, in the embodiment of FIG. 5, the outer periphery of the cylindrical element 1b' or the inner periphery of the cylindrical element 1b can accommodate a tube coil such as that shown at 12 or 13 in FIGS. 1 and 2, or a thin liquid-carrying casing such as has been shown at 12a and 13a in FIG. 4. In the latter case, the casings will be cylindrical and in the former case the coils will conform to right circular cylindrical helices.

A common igniter can be provided for both heating elements in the FIG. 5 embodiments if the heating elements are bridged as represented diagrammatically at 28b.

I claim:

1. A boiler or steam generator comprising:

a thermally insulated housing;

at least one pair of vertically disposed spacedly juxtaposed catalyst elements received in said housing for catalytic combustion of a fuel to produce heat;

a pair of imbricated tube coils having vertical axes and disposed between but spaced from said elements and forming a radiation shield between them preventing direct radiation of one of said elements onto another;

means for feeding a liquid to be heated to said coils at the bottom of said housing; and a collector for heated fluid communicating with said coils at the top thereof.

2. The boiler or steam generator defined in claim 1, further comprising at least one additional tube coil disposed behind said elements and carrying a fluid to be heated.

3. The boiler or steam generator defined in claim 1, further comprising a casing containing a continuous sheet of a liquid to be heated disposed along the rear of one of said elements.

4. The boiler or steam generator defined in claim 1, further comprising a cupola-shaped structure above said elements and said coils and formed by at least one coiled tube for conducting combustion gases away from said elements, said coil tube being traversed by a liquid to be heated.

5. The boiler or steam generator defined in claim 4 wherein said cupola is formed from a single layer of the coiled tube with successive turns joined together.

6. The boiler or steam generator defined in claim 4 wherein said cupola is formed by a pair of imbricated tube coils.

7. The boiler or steam generator defined in claim 4 wherein said coiled tube is connected to one of said tube coils and constitutes an extension thereof.

8. The boiler or steam generator defined in claim 4 wherein said coiled tube forms part of a circuit for heating liquid independently of said tube coils.

9. The boiler or steam generator defined in claim 1 wherein said housing has a polygonal horizontal section, said elements are vertical panels disposed along sides of polygons and said tube coils are helices of polygonal axial section.

10. A boiler or steam generator comprising:

a thermally insulated housing;

at least one pair of vertically disposed spacedly juxtaposed catalyst elements received in said housing for catalytic combustion of a fuel to produce heat;

a pair of imbricated tube coils disposed between said elements and forming a radiation shield between them;

means for feeding a liquid to be heated to said coils at the bottom of said housing; and a collector for heated fluid communicating with said coils at the top thereof, said housing having a polygonal horizontal section, said elements being vertical panels disposed along sides of polygons and said tube coils being helices of polygonal axial section; and further comprising support tubes at the vertices of the polygon secured to said tube coils and traversed by the fluid to be heated.

11. The boiler or steam generator defined in claim 1 wherein said housing and said tube coils are of horizontal circular section.

12. The boiler or steam generator defined in claim 1 wherein said elements are bridged by a further catalyst element whereby a single igniter can serve to trigger said elements into operation.

* * * * *